US007351056B2

(12) United States Patent
De Raedt et al.

(10) Patent No.: US 7,351,056 B2
(45) Date of Patent: Apr. 1, 2008

(54) METHOD AND APPARATUS FOR INTRODUCING MATERIALS INTO A ROTARY KILN

(75) Inventors: Frederick De Raedt, Ann Arbor, MI (US); Thomas R. Largent, Millville, CA (US)

(73) Assignee: Holcim (US) Inc., Dundee, MI (US)

( * ) Notice: Subject to any disclaimer, the term of this patent is extended or adjusted under 35 U.S.C. 154(b) by 188 days.

(21) Appl. No.: 11/271,206

(22) Filed: Nov. 10, 2005

(65) Prior Publication Data

US 2007/0102277 A1 May 10, 2007

(51) Int. Cl.
*B66C 17/08* (2006.01)

(52) U.S. Cl. ..... 432/117; 414/149

(58) Field of Classification Search ..... 432/117, 432/103, 105; 110/246, 255; 414/147, 149, 414/152, 172, 199

See application file for complete search history.

(56) References Cited

U.S. PATENT DOCUMENTS 4,850,290 A 7/1989 Benoit et al.
4,930,965 A 6/1990 Peterson et al.
4,974,529 A 12/1990 Benoit et al.
5,086,716 A 2/1992 Lafser, Jr.
5,122,189 A 6/1992 Garrett et al.
5,156,676 A 10/1992 Garrett et al.
5,224,433 A 7/1993 Benoit et al.
5,226,774 A 7/1993 Tutt et al.
5,377,603 A 1/1995 Reese et al.
5,549,058 A * 8/1996 Tutt ..... 110/226
5,632,616 A * 5/1997 Tutt et al. ..... 432/105
5,724,896 A * 3/1998 Koenig ..... 110/246
5,724,899 A 3/1998 Reese et al.
6,050,203 A 4/2000 Reese et al.
6,676,407 B2 * 1/2004 Largent ..... 432/242

* cited by examiner

*Primary Examiner*—Gregory Wilson
(74) *Attorney, Agent, or Firm*—Tomlinson & O'Connell, PC

(57) ABSTRACT

An apparatus for introducing a material into a kiln using low pressure air injection. In a preferred embodiment, that apparatus has a movable vessel that is movable between a collection position and a discharge position. The vessel has an open top and an open base. The open base supports a discharge gate that is movable between an open position and a closed position. In the closed position, the discharge gate prevents discharge of the material from the vessel while the vessel is moving from the collection position to the discharge position. An actuable vessel cover is adapted to cover the open top of the vessel when the vessel is at the discharge position. A low pressure air injection assembly, supported by the vessel cover, injects air into the vessel to force discharge of the material through the open base, the discharge gate and into the kiln.

34 Claims, 2 Drawing Sheets

METHOD AND APPARATUS FOR INTRODUCING MATERIALS INTO A ROTARY KILN

FIELD OF THE INVENTION

This invention relates generally to the field of manufacturing cement clinker, and in particular to a method and apparatus for introducing materials into a rotary kiln.

SUMMARY OF THE INVENTION

The present invention is directed to an apparatus for introducing a material into a kiln. The apparatus comprises a movable vessel for supporting the material, a discharge gate supported by the vessel, an actuable vessel cover, and an air injection system. The vessel comprises an open top and an open base. The vessel is movable between a collection position and a discharge position. The discharge position is adjacent to and substantially above the kiln. The discharge gate is movable between an open position and a closed position, such that the gate prevents discharge of the material from the vessel when the vessel is moved from the collection position to the discharge position. The actuable vessel cover is adapted to cover the open top of the vessel when the vessel is in the discharge position. The low pressure air injection assembly is supported by the vessel cover and adapted to force discharge of the material through the open base, the discharge gate and through the kiln opening.

The present invention further includes a method for introducing a material into a rotary kiln system. The system comprises a rotary kiln having a kiln opening and a vessel disposed at a discharge position above the rotary kiln. The vessel comprises an open top, an open base and a discharge gate. The method comprises providing the material into the vessel through the open top of the vessel, maintaining the material within the vessel with the discharge gate, opening the discharge gate, and supplying low pressure air to the vessel such that the material is discharged through the open base and through the kiln opening.

Further still, the present invention includes a kiln system for the manufacture of cement. The kiln system comprises a rotary kiln having a sidewall, an opening formed in the sidewall of the rotary kiln, a movable vessel, a discharge gate supported by the vessel, an actuable vessel cover, and a low pressure air injection system. The kiln opening is adapted for the introduction of a material into the rotary kiln. The movable vessel supports the material and comprises an open top and an open base. The vessel is movable between a collection position and a discharge position. The discharge gate is supported by the movable vessel and movable between an open position and a closed position, such that the gate prevents discharge of the material from the vessel when the gate is in the closed position. The actuable vessel cover is adapted to cover the open top of the vessel when the vessel is in the discharge position. The low pressure air injection assembly is supported by the vessel cover and adapted to force discharge of the material through the open base of the vessel, the discharge gate and the opening formed in the sidewall of the kiln.

BRIEF DESCRIPTION OF THE DRAWINGS

FIG. 2 illustrates the use of a movable vessel used to position the materials above the kiln and a plenum box used to cover the movable vessel and cause discharge of the material through the bottom of the vessel.

DESCRIPTION OF THE PREFERRED EMBODIMENT

Figure 1:
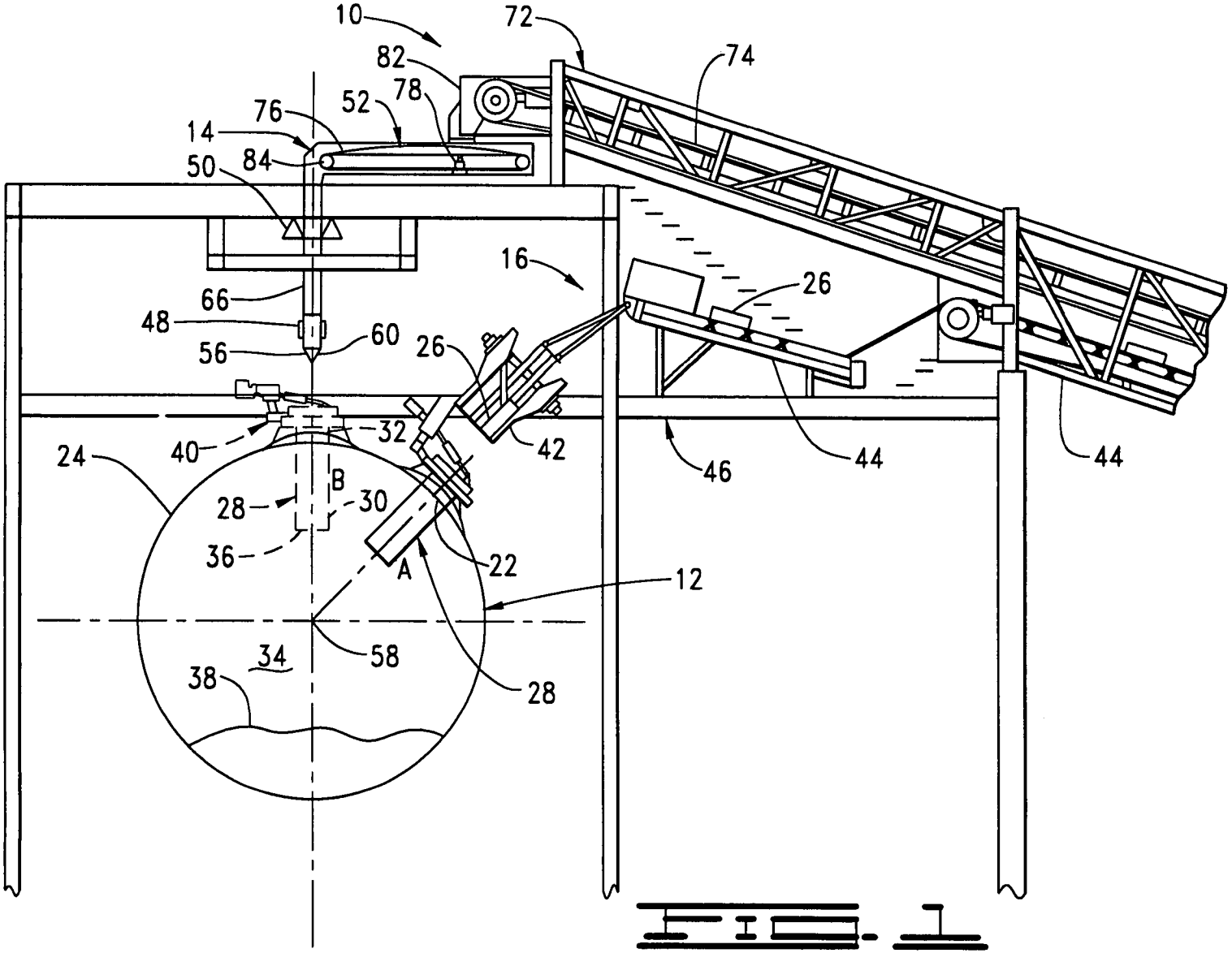
FIG. 1 is a partially sectional, diagrammatic view of the kiln system of the present invention showing a system for delivering materials into a rotary kiln.

Turning now to the drawings in general, and in particular to FIG. 1 there is shown therein a kiln system 10 constructed in accordance with the present invention. For purposes of illustration only, the present invention is described with reference to manufacturing cement clinker. It will be appreciated that the invention described herein may be used in conjunction with other kiln systems without departing from the spirit of the present invention.

Cement clinker kiln systems 10 operate at extremely high temperatures sufficient to dispose of various materials having different compositions. These materials may comprise raw materials, waste materials, or alternative sources of fuel. The use of alternative fuels and alternative raw materials reduces the demand for primary fuels and raw materials thereby decreasing manufacturing costs. Accordingly, the cement industry has developed systems and methods for introducing these materials into kiln systems 10. However, there remains a need for improved system for delivering such materials into kiln systems 10.

Figure 2:
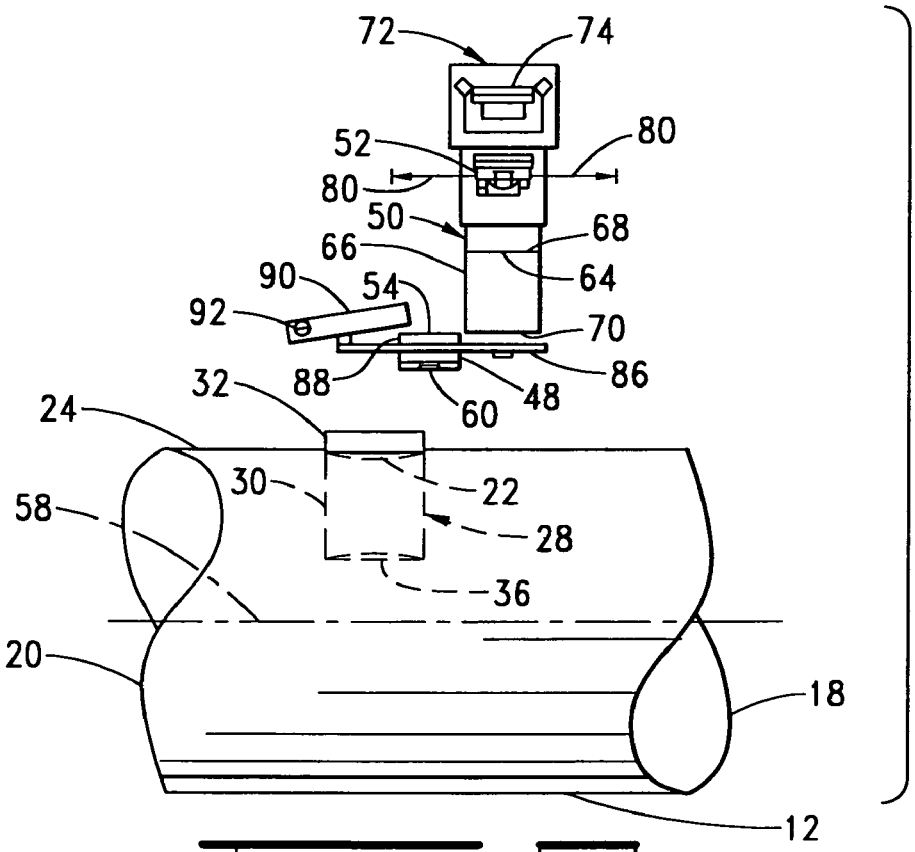
FIG. 2 is a side view of the kiln system shown in FIG. 1.

The kiln system 10 shown in FIG. 1 comprises a rotary kiln 12, an apparatus 14 for introducing a material into the kiln and a whole tire delivery system 16. It will be appreciated that materials, as used herein, may include distressed coal, cement kiln dust, contaminated soils, paper and wood products, plastics, bone meal, fly ash, diapers, sludges, shingles, tires, drill cuttings, animal wastes and other combustible materials, non-combustible materials, hazardous and non-hazardous wastes, and supplemental fuels. The rotary kiln 12 may comprise an elongate tubular member having a feed end 18 (FIG. 2) and an outlet end 20 (FIG. 2). The rotary kiln 12 may be generally inclined so that the feed end 18 of the kiln is higher than the outlet end 20 of the rotary kiln. The raw materials used to make the cement clinker are feed into the feed end 18 of the kiln 12 and travel downward toward the outlet end 20 of the kiln as the kiln is rotated. It will be appreciated that the raw materials may be preheated in a preheater/precalciner system before introduction into the kiln system 10. Raw materials fed into the kiln 12 may comprise lime, silica and various other materials such as aluminum, slate, and calcium. As the raw materials travel the length of the kiln 12 they are heated to temperatures sufficient to cause the raw materials to fuse and form cement clinker. The newly formed clinker passes from the rotary kiln 12 into a cooling system (not shown) where it is cooled for further processing.

Referring still to FIG. 1, the rotary kiln 12 is shown in cross-section from the outlet end 20 of the kiln. FIG. 1 illustrates the position of an opening 22 formed in the sidewall 24 of the rotary kiln 12. The kiln opening 22 is generally characterized as a feed opening that is adapted for the introduction of materials into the rotary kiln 12. In FIG. 2, the kiln opening 22 is supported by the sidewall 24 of the kiln and shown in two positions. The kiln opening 22 is generally positioned near the longitudinal midpoint (not shown) of the kiln 12. The kiln opening 22 may be sized and adapted to accept many different types and sizes of materials into the kiln 12. In a first Position A, the kiln opening 22 is positioned to accept supplemental fuels in the form of whole tires 26 from the tire delivery system 16. In Position B the kiln opening 22 is positioned to accept materials from the apparatus of the present invention.

The kiln opening 22 supports a feed chute 28 supported by and transecting the sidewall 24 of the rotary kiln 12. The feed chute 28 is generally elongate and comprises an interior portion 30 and an exterior portion 32. The interior portion 30 of the feed chute 28 extends within the interior 34 of the kiln 12 so that an outlet 36 of the feed chute 28 extends above the in-process raw materials 38 when the kiln opening 22 passes through the bottom of the kiln rotation cycle. The feed chute 28 is generally tubular and sized so that a wide variety of materials are able to pass through the chute and into the interior 34 of the kiln 12. The exterior portion 32 of the feed chute 28 extends beyond the sidewall 24 of the rotary kiln 12 and supports a kiln door assembly 40.

The kiln door assembly 40 is supported on the external portion 32 of the feed chute 28 and adapted to automatically open. A suitable kiln door assembly 40 is disclosed in U.S. Pat. No. 6,676,407 issued to Largent, the contents of which are incorporated herein by reference. However, one skilled in the art will appreciate that any kiln door assembly capable of closing the kiln opening 22 may be used without departing from the spirit of the present invention. The kiln door assembly 40 of FIG. 1 is adapted to actuate automatically so that the kiln opening 22 and feed chute 28 are open to receive supplemental fuels when the kiln opening 22 is in Position A and supplemental materials when in Position B.

A fuel delivery platform 42 may be disposed adjacent to the rotary kiln 12 to deliver supplemental fuel 26 to the feed chute 28. The fuel delivery platform 42 is adapted to time the release of the supplemental fuel 26 in coordination with opening of the kiln door assembly 40 when the kiln opening 22 is in Position A. The fuel delivery platform 42 is positioned and angled so that the supplemental fuel 26 is gravity fed into the feed chute 28. A fuel delivery platform 42 suitable for delivering supplemental fuel to the kiln opening 22 when the opening is in Position A is described in U.S. Pat. No. 6,234,091, the contents of which are incorporated herein by reference. A generally known conveyor system 44 may be used to move the supplemental fuel 26 from storage (not shown) to the fuel delivery platform 42. The conveyor system 44 and fuel delivery system 42 may be supported adjacent to the kiln 12 using an elevated platform.

Figure 3:
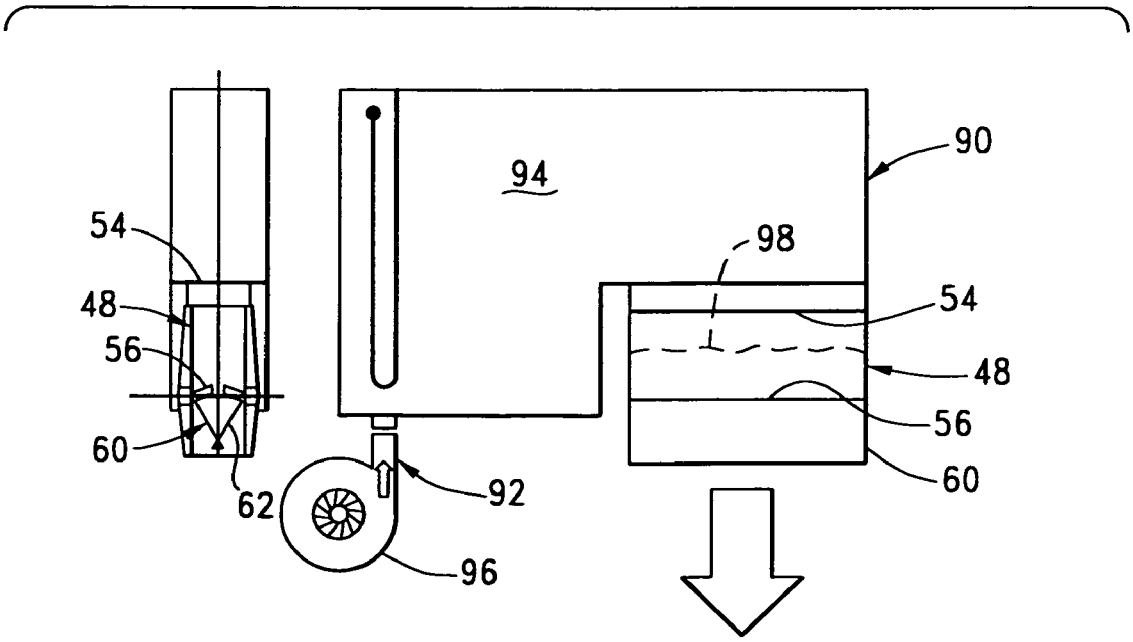
FIG. 3 is a side view of the plenum box of FIG. 2 showing engagement of the movable vessel and plenum box.

With continuing reference to FIG. 1, there is shown therein the apparatus 14 for introducing materials into the rotary kiln 12 using air pressure injection. The apparatus comprises a movable vessel 48 for supporting the material to be injected into the kiln 12 and a collection member 50 adapted to measure a predetermined amount of material received from an oscillating conveyor 52. The movable vessel 48 comprises a substantially rectangular box having an open top 54 (FIG. 3) and an open base 56 (FIG. 3). The movable vessel 48 is positioned above the kiln 12 so that it may travel along a path substantially parallel to the longitudinal axis 58 of the rotary kiln 12. A discharge gate 60 may be operatively supported by the vessel 48 to prevent discharge of the material from the vessel when the vessel is moving from a collection position under the collection member 50 to a discharge position over the kiln opening 22 (FIG. 2).

Referring now to FIG. 3, the discharge gate 60 may comprise at least one door 62 pivotally connected to the open base 56 of the movable vessel 48 to minimize leakage of the material from the vessel. The discharge gate 60 preferably may comprise two doors 62 actuable to open beyond perpendicular with the open base 56 of the movable vessel 48. As shown in FIG. 3, the doors 62 may be operatively connected to the vessel 48 near the open base 56. The doors 62 may be actuable either manually or in response to activation of a sensor (not shown) adapted to detect alignment of the kiln opening 22 with the discharge gate 60.

The collection member 50 is disposed near the collection position of the movable vessel 48 and comprises four sidewalls arranged to form a generally rectangular member having an open top and a closeable bottom 64 (FIG. 2). The collection member 50 is adapted to receive a predetermined amount of material from the oscillating conveyor 52 and to transfer the material to the movable vessel 48 through the closeable bottom 64 when a predetermined amount of material is present in the collection member. One skilled in the art will appreciate that the collection member 50 may comprise a weigh hopper having a gate valve (not shown) that is capable of opening automatically when a predetermined amount of material is present in the weigh hopper.

A transfer chute 66 is disposed under the closeable bottom 64 of the collection member 50 and above the movable vessel 48, when the vessel is in the collection position. As shown in FIGS. 1 and 2 and the transfer chute 66 is generally elongate and comprises an inlet 68 and an outlet 70. The inlet 68 may be sized so that its opening is substantially the same size and configuration of the closeable bottom 64 of the collection member 50. Likewise, the outlet 70 of the transfer chute 66 may be constructed to have an opening of substantially the same size and configuration as the open top 54 of the movable vessel 48.

Referring to FIG. 1, material is provided to the collection member 48 using a conveyor system 72. The conveyor system 72 comprises a delivery conveyor 74 and a means for loading the material into the collection member such that the material is substantially evenly distributed about the collection member. Such means may comprise a conveyor or bucket elevator adapted to bring material from a storage bin (not shown) to the collection member 50. The means for loading the material into the collection member shown in FIG. 1 comprises the conveyor 52 adapted to oscillate over the open top of the collection member 50. The oscillating conveyor 50 comprises a horizontal conveyor 76 supported on a pivot 78. The oscillating conveyor 52 pivots about arc 80 over the top of the collection member 50 to deposit the materials evenly within the collection member 50.

Turning now to FIG. 2 a diagrammatic representation of the kiln system 10 of the present invention is shown. FIG. 2 illustrates the use of the movable vessel 48 to position the supplemental materials above the kiln 12 and an actuable vessel cover 90 used to cover the movable vessel 48 and cause discharge of the material through the bottom of the vessel 56. The kiln 12 of FIG. 2 is shown with the kiln opening 22 and feed gate 40 in Position B (FIG. 1). The delivery conveyor 74 is shown positioned above the oscillating conveyor 52 so that material falling from the end 82 (FIG. 1) of the delivery conveyor 74 is delivered to the oscillating conveyor 52. As previously discussed, the oscillating conveyor 52 is positioned above the collection vessel 50 so that material falling from the distal end 84 of the oscillating conveyer 52 is evenly distributed within the collection vessel 50.

The collection vessel 50, as shown in FIG. 2, comprises the closeable bottom 64 and is positioned between the oscillating conveyor 52 and the transfer chute 66. The transfer chute 66 is generally elongate and extends from the closeable bottom 64 of the collection member 50 downward toward the movable vessel 48.

The movable vessel 48 may be supported on a rail system 86 running parallel to the longitudinal axis 58 of the kiln 12. Wheels 88 may be operatively connected to the vessel 48 as illustrated in FIG. 2 to facilitate movement of the vessel along the rail system 86 from the collection position to the discharge position.

The actuable vessel cover 90 comprising a plenum box is supported on the rail system 86 above the kiln opening 22. The actuable vessel cover 90 is adapted to cover the open top 54 of the movable vessel 48 when the vessel is in the discharge position. A low pressure air injection assembly 92 is supported by the vessel cover 90 and adapted to force discharge of the material through the open base 56 of the movable vessel 48, the discharge gate 60, and through the kiln opening 22. The construction and function of the movable vessel 48 and the actuable vessel cover 90 will be discussed in more detail herein with reference to FIG. 3.

Referring now to FIG. 3, there is shown therein the movable vessel 48 and the actuable vessel cover 90. The vessel cover 90 may comprise a plenum box having a large internal space 94. The internal space 94 of the vessel cover 90 may be in the range of ten cubic feet to sixty cubic feet and more preferably forty-eight (48) cubic feet. A low-pressure air injection system 92 is supported by the vessel cover 90 and adapted to generate air pressure within the internal space 94 of the plenum box. The air pressure generated by the low-pressure air injection system 92 may range from five one-hundredths (0.05) of a pound per square inch to thirty-five (35) pounds per square inch. More preferably, the air pressure generated by the low-pressure air injection system 92 may range from one-tenth (0.1) of a pound per square inch to one (1) pound per square inch. The low-pressure air injection system 92 may comprise a fan 96 adapted to draw air into the vessel cover 90. The air pressure generated by the fan 96 pushes on the material within the vessel 98 so that when the discharge gate 60 is opened the material is forced down and out of the vessel. It will be appreciated by one skilled in the art that a bellow or diaphragm may be used to supply low pressure air to the closed vessel 48.

Referring now to FIGS. 1-3, the operation of the kiln system will be discussed. In operation, supplemental fuels such as whole tires 26 are placed on the fuel delivery platform 42 either manually or by using the conveyor system 44 shown in FIG. 1. As the kiln 12 is rotated the kiln opening 22 comes into alignment with the fuel delivery platform 42. At that point, a known sensor (not shown) sends a signal to open the kiln door assembly 40. The tire 26 or other combustible material is released from the fuel delivery platform 42 and fed into the kiln 12. Once the supplemental fuel 26 has entered the kiln 12 and the kiln has rotated past the fuel delivery platform 42, the kiln door assembly 40 closes until the next sensor is encountered.

As the kiln rotates further the kiln opening 22 comes into alignment with the discharge position of the movable vessel 48. During rotation of the kiln 12, the supplemental material is transported to the oscillating conveyor 56 using the delivery conveyor 74. The oscillating conveyor 52 is activated to pivot about the pivot axis 78 and place material into the collection member 50 comprising the weigh hopper. Once a predetermined amount of material has been placed into the collection member 30, the closeable bottom 64 opens and the material is gravity fed through the transfer chute 66 and into the movable vessel 48. The movable vessel 48 is filled with an appropriate amount of material and then automatically moved from the collection point to the discharge point along the rail system 86.

Once the movable vessel 48 reaches the discharge point, the actuable vessel cover 90 comprising a plenum box is actuated to pivot downward and cover the open top 54 of the movable vessel. Once the vessel cover 90 is pivoted downward, the low-pressure air injection system 92 is activated to build air pressure within the internal space 94 and on the material. After sufficient air pressure has been achieved within the vessel cover 90, the discharge gate 60 is opened and the material is discharged through the open base 56 and into the kiln 12. The air injection system 92 may comprise a fan 96 (FIG. 3) that is capable of generating air pressure within the internal space 94 to force the discharge of the material from the movable vessel 48 and into the kiln 12. The fan 96 (FIG. 3) may be adapted to generate air pressures within the internal space 94 in the range of 0.1 pounds per square inch to thirty-five (35) pounds per square inch. After the material is injected into the kiln 12 at position B the discharge gate 60 and the kiln door assembly 40 are closed until the kiln 12 arrives at either positions A or B.

In observation, materials having a mass of less than thirty-four (34) pounds per cubic foot were released from the movable vessel 48 and observed to travel four (4) feet at, or less than, 0.34 seconds under air pressure of 0.25 pounds per square inch. In contrast, the same materials released from the movable vessel 48 under the force of gravity alone were observed to travel four (4) feet in approximately 0.50 seconds.

The present invention also includes a method for introducing supplemental materials into a rotary kiln system 10. The system comprises the rotary kiln 12 having the kiln opening 22, the vessel 48 disposed at the discharge position above the rotary kiln. The vessel 48 comprises the open top 54 and discharge gate 60. The method comprises providing the supplemental material into the moveable vessel 48 while the vessel is positioned at a collection point below a collection member 50.

The method comprises measuring a predetermined amount of supplemental material into a collection member 50 that may comprise a weigh hopper. The supplemental material is preferably evenly distributed within the collection member. The supplemental material is then transferred via the transfer chute 66 into the movable vessel 48. The supplemental material is maintained within the vessel 48 using the closed discharge gate 60. The vessel 48 is moved along the rail system 86 to the discharge point. Once the vessel 48 arrives at the discharge point, the low pressure system is activated. Sufficient air pressure is achieved when the kiln opening 22 comes into alignment with the movable vessel 48 and the discharge gate 60 is opened. The supplemental material 98 discharged through the open base 56 and through the kiln opening 22 into the kiln 12 where it is combusted or otherwise utilized in the cement manufacturing process.

Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that within the scope of the appended claims, the invention may be practiced otherwise than as specifically illustrated and described.

What is claimed is:

1. An apparatus for introducing a material into a kiln, the apparatus comprising:

a movable vessel for supporting the material, the vessel comprising an open top and an open base;

wherein the vessel is movable between a collection position and a discharge position, the discharge position being adjacent to and substantially above the kiln;

a discharge gate supported by the vessel, the discharge gate being movable between an open position and a closed position, such that the gate prevents discharge of the material from the vessel when the vessel is moved from the collection position to the discharge position, and an actuable vessel cover adapted to cover the open top of the vessel when the vessel is in the discharge position;

a low pressure air injection assembly supported by the vessel cover and adapted to force discharge of the material through the open base, the discharge gate and through the kiln opening.

2. The apparatus of claim 1 further comprising a collection member disposed near the collection position of the vessel, the collection member comprising an open top and a closable bottom, wherein the collection member is adapted to measure a predetermined amount of the material therein and to transfer the material to the vessel through the closable bottom when the predetermined amount of material is within the collection member.

3. The apparatus of claim 2 further comprising a means for loading the material into the collection member such that the material is substantially evenly distributed about the collection member.

4. The apparatus of claim 3 wherein the means for loading the material comprises a conveyor adapted to oscillate over the open top of the collection member.

5. The apparatus of claim 1 wherein the air injection assembly comprises a fan assembly adapted to exert substantially even air pressure over the material in the range of one-tent (0.1) of a pound per square inch to thirty-five (35) pounds per square inch.

6. The apparatus of claim 1 wherein the discharge gate comprises at least one door pivotally connected to the open base of the vessel.

7. The apparatus of claim 1 wherein the actuable vessel cover comprises a plenum box adapted to seal the vessel when the vessel is in the discharge position.

8. The apparatus of claim 1 wherein the material comprises a combustible component.

9. The apparatus of claim 1 wherein the material comprises a raw material for the manufacture of cement clinker.

10. The apparatus of claim 1 wherein the material comprises a non-combustible component.

11. The apparatus of claim 1 wherein the discharge gate comprises at least one door.

12. The apparatus of claim 11 wherein the at least one door is actuable such that it opens beyond perpendicular with the base of the vessel.

13. The apparatus of claim 11 wherein the at least one door closes the base of the vessel to prevent leakage of the material from the vessel.

14. The apparatus of claim 1 wherein the actuable vessel cover comprises a plenum box actuable in response to movement of the vessel between the collection position and the discharge position.

15. A method for introducing a material into a rotary kiln system, the system comprising a rotary kiln having a kiln opening, a vessel disposed above the kiln at a discharge position above the rotary kiln, the vessel comprising an open top, an open base and a discharge gate connected to the vessel, the method comprising:

providing the material into the vessel through the open top of the vessel;

holding the material within the vessel with the discharge gate;

supplying low-pressure air to the vessel; and opening the discharge gate to allow discharge of the material through the open base of the vessel, open discharge gate, and through the kiln opening under the force of the low-pressure air.

16. The method of claim 15 further comprising moving the vessel between a collection point and the discharge position.

17. The method of claim 15 further comprising measuring a predetermined amount of material in a collection member before providing the material into the vessel.

18. The method of claim 17 wherein measuring a predetermined amount of material in the collection member further comprises distributing the material within the collection member substantially evenly by weight.

19. The method of claim 15 wherein the rotary kiln system further comprises a kiln door covering the kiln opening, the method further comprising automatically opening the kiln door when the kiln door is substantially aligned with the discharge gate.

20. A kiln system for the manufacture of cement comprising:

a rotary kiln having a sidewall;

an opening formed in the sidewall of the rotary kiln, the opening being adapted for the introduction of a material into the rotary kiln;

a movable vessel for supporting the material, the vessel comprising an open top and an open base;

wherein the vessel is movable between a collection position and a discharge position;

a discharge gate supported by the vessel, the discharge gate being movable between an open position and a closed position, such that the gate prevents discharge of the material from the vessel when the gate is in the closed position;

an actuable vessel cover adapted to cover the open top of the vessel when the vessel is in the discharge position; and a low-pressure air injection assembly supported by the vessel cover and adapted to force discharge of the material through the open base of the vessel, the discharge gate and the opening formed in the sidewall of the kiln.

21. The kiln system of claim 20 further comprising a collection member disposed near the collection position of the vessel, the collection member comprising an open top and a closable bottom, wherein the collection member is adapted to measure a predetermined amount of the material therein and to transfer the material to the vessel through the closable bottom when the predetermined amount of material is within the collection member.

22. The kiln system of claim 21 further comprising a means for loading the material into the collection member such that the material is substantially evenly distributed about the collection member.

23. The kiln system of claim 22 wherein the means for loading the material comprises a conveyor adapted to oscillate over the open top of the collection member.

24. The kiln system of claim 20 wherein the air injection assembly comprises a fan assembly adapted to exert substantially even air pressure over the material in the range of one-tenth (0.1) of a pound per square inch to thirty-five (35) pounds per square inch.

25. The kiln system of claim 20 wherein the discharge gate comprises at least one door pivotally connected to the open base of the vessel.

26. The kiln system of claim 20 wherein the actuable vessel cover comprises a plenum box adapted to seal the vessel when the vessel is in the discharge position.

27. The kiln system of claim 20 wherein the material comprises a combustible material.

28. The kiln system of claim 20 wherein the material comprises a non-combustible component.

29. The kiln system of claim 20 wherein the discharge gate comprises a plurality of doors.

30. The kiln system of claim 29 wherein the plurality of doors are actuable such that they open beyond perpendicular with the base of the vessel.

31. The kiln system of claim 29 wherein the plurality of doors close the base of the vessel to prevent leakage of the materials when the discharge gate is in the closed position.

32. The kiln system of claim 20 wherein the vessel cover comprises a plenum box pivotally actuable in response to movement of the vessel between the collection position and the discharge position.

33. The kiln system of claim 20 wherein the air injection assembly comprises:

a fan adapted to draw air into the vessel cover; and an air distributor supported within the vessel cover and adapted to exert substantially even air pressure over the material.

34. The kiln system of claim 20 wherein the material comprises a raw material for the manufacture of cement clinker.

* * * * *